US007718959B2

(12) United States Patent
Franzen et al.

(10) Patent No.: US 7,718,959 B2
(45) Date of Patent: May 18, 2010

(54) STORAGE BANK FOR IONS

(75) Inventors: Jochen Franzen, Bremen (DE); Gökhan Baykut, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 216 days.

(21) Appl. No.: 11/843,753

(22) Filed: Aug. 23, 2007

(65) Prior Publication Data

US 2008/0048113 A1 Feb. 28, 2008

(30) Foreign Application Priority Data

Aug. 25, 2006 (DE) ..... 10 2006 040 000

(51) Int. Cl.
*H01J 49/42* (2006.01)

(52) U.S. Cl. ..... 250/290; 250/281; 250/293

(58) Field of Classification Search ..... 250/292, 250/283, 396 R, 290, 282
See application file for complete search history.

(56) References Cited

U.S. PATENT DOCUMENTS

| | | | | |
|---|---|---|---|---|
| 5,179,278 | A | 1/1993 | Douglas | 250/290 |
| 5,420,425 | A * | 5/1995 | Bier et al. | 250/292 |
| 5,572,035 | A * | 11/1996 | Franzen | 250/396 R |
| 5,763,878 | A * | 6/1998 | Franzen | 250/292 |
| 5,811,800 | A | 9/1998 | Franzen et al. | 250/288 |
| 6,838,666 | B2 | 1/2005 | Ouyang et al. | 250/292 |
| 7,019,286 | B2 | 3/2006 | Fuhrer et al. | 250/287 |
| 7,095,013 | B2 | 8/2006 | Bateman et al. | 250/281 |
| 7,189,965 | B2 * | 3/2007 | Franzen | 250/283 |
| 7,381,947 | B2 * | 6/2008 | Senko | 250/292 |
| 2005/0258364 | A1 | 11/2005 | Whitehouse et al. | 250/292 |
| 2005/0285029 | A1 * | 12/2005 | Franzen | 250/283 |
| 2006/0027745 | A1 | 2/2006 | Rebettge et al. | 250/292 |
| 2006/0284080 | A1 * | 12/2006 | Makarov et al. | 250/290 |
| 2007/0034810 | A1 * | 2/2007 | Hoyes | 250/396 R |
| 2008/0067362 | A1 * | 3/2008 | Senko | 250/292 |
| 2008/0111070 | A1 * | 5/2008 | Makarov et al. | 250/290 |
| 2008/0251712 | A1 * | 10/2008 | Sanders et al. | 250/282 |
| 2008/0251715 | A1 * | 10/2008 | Nikolaev et al. | 250/288 |
| 2008/0265155 | A1 * | 10/2008 | Kovtoun | 250/292 |

FOREIGN PATENT DOCUMENTS

| | | |
|---|---|---|
| WO | WO 2006/049623 | 11/2006 |
| WO | WO 2007/130303 | 11/2007 |

* cited by examiner

*Primary Examiner*—Nikita Wells
*Assistant Examiner*—Johnnie L Smith
(74) *Attorney, Agent, or Firm*—O'Shea Getz P.C.

(57) ABSTRACT

The invention relates to instruments for storing ions in more than one ion storage device and to the use of the storage bank thus created. The ion storage bank includes several storage cells configured as RF multipole rod systems, where the cells contain damping gas and are arranged in parallel. Each pair of pole rods is used jointly by two immediately adjacent storage cells such that the ions collected can be transported from one storage cell to the next by briefly applying DC or AC voltages to individual pairs of pole rods. The ions can thus be transported to storage cells in which they are fragmented or reactively modified, or from which they can be fed to other spectrometers. In particular, a circular arrangement of the storage cells on a virtual cylindrical surface makes it possible to accumulatively fill the storage cells with ions of specific fractions from temporally sequenced separation runs.

16 Claims, 5 Drawing Sheets

STORAGE BANK FOR IONS

PRIORITY INFORMATION

This patent application claims priority from German patent application 10 2006 040 000.3 filed Aug. 25, 2006, which is hereby incorporated by reference.

FIELD OF THE INVENTION

The invention relates to devices for storing ions in more than one ion storage volume and to the use of the storage bank thus created.

BACKGROUND OF THE INVENTION

Most mass spectrometers in use today basically operate discontinuously; they deliver mass spectra at rates which nowadays are generally between one and a maximum of twenty mass spectra per second. If daughter or granddaughter ion spectra are measured, the scan rate sinks considerably. There are, as yet, no commercially available mass spectrometers which can record and deliver a hundred or more spectra per second. Time-of-flight mass spectrometers with orthogonal ion injection can operate with 5,000 to 15,000 individual spectra per second, which are digitized in transient recorders and added in real time; but, for reasons connected with the spectrum quality, dynamic range of measurement and reading speed, it is necessary to acquire and add together several hundred mass spectra before a mass spectrum can be read out of the digital memory of the transient recorder. Even today, it still takes at least five to ten milliseconds to read out the mass spectrum with its hundreds of thousands of values; if a hundred mass spectra were sampled per second the whole time would be taken up solely with the reading out. Since the trend is to higher digitization rates and thus to longer value sequences for a mass spectrum, no improvement is to be expected here.

Despite the discontinuous operation of most types of mass spectrometer (at least those with separate ion sources and mass analyzers), a mass spectrometer usually has an ion current somewhere between the ion source and mass analyzer which is more or less continuous, or, depending on the type of ion source, sometimes also pulsed. This ion stream is generally used to fill an ion storage device from which the ions are delivered to the discontinuously operating mass analyzer. If the mass spectrometer is connected to a separation unit such as a chromatograph, the ions from various substance peaks of the separation unit become mixed in this ion storage device to a greater or lesser extent, depending on the separation speed.

U.S. Pat. No. 5,811,800 discloses a storage bank for ions which can temporarily store ions of consecutive substance peaks generated from the substance stream of a separating device, such as a liquid chromatograph, in order to feed the stored ions, time-matched, to a mass spectrometric analysis each time without them mixing further with ions of another substance peak. This makes it possible, to a certain extent, to temporally decouple an optimal mass spectrometric analytical method from the separation method. It is thus possible not only to subject the ions from a chromatographic substance peak to a mass spectrometric measurement but also, if it proves useful, to acquire daughter ion spectra of selected and subsequently fragmented parent ions, or also to acquire granddaughter ion spectra of selected daughter ions in order to carry out definite identification of the substance or to elucidate the primary structure. Then the analysis of the ions of the next substance peak begins.

The storage bank disclosed in U.S. Pat. No. 5,811,800 cannot accumulate ions, however. It cannot store identical fractions of ions from consecutive separation runs in the same storage cells because the storage cells arranged in series can only be filled from the preceding storage cell, and thus do not permit a second filling with ions from the same type of fraction from a subsequent separation run.

The terms able to accumulate or accumulating shall mean that it should be possible to later add more selected ions to those collected earlier in the ion storage devices, and that other ion storage devices can also be filled in the meantime, with other ionic species, for example.

The ever increasing speed of separation methods creates a need for storage banks able to accumulate ions. It is thus to be expected that there will be separation methods on chips that carry out a complete electrophoretically assisted chromatographic separation run in only one second, but which separate only very little substance each time. Therefore the aim is to develop an accumulating fraction sampler to increase the dynamic range of measurement. The duration of the substance peaks may amount to only a few milliseconds.

Different ion species are separated even faster by their ion mobility in gas-filled drift regions. In this case, a single separation run takes only about 20 to 100 milliseconds, sometimes even less. The duration of the separated ion peaks also is in the order of only a few milliseconds or even less, especially with low-pressure drift regions.

As already explained above, there is, as yet, no mass spectrometer that can analytically follow ion peaks that are changing so rapidly, or which are so sensitive that they can manage with the small ion quantities in the peaks. For such fast separation methods it is therefore desirable to be able to collect identical ion fractions from consecutive separation runs accumulatively in a storage cell of a storage bank in order to feed the ions collected in this way to the analyzer in sufficient numbers and temporally decoupled.

U.S. Pat. No. 7,019,286 (K. Fuhrer et al.) describes a time-of-flight mass spectrometer with which extremely fast ion reaction processes can be followed. It uses a split detector that separates the long ion threads, which are injected into the pulser and which fly in a largely undisturbed formation through the flight tube region, into sections which can each be detected separately. Since the ion threads fly into the pulser in a few tens of microseconds, it is thus possible to use them to observe processes that change in time periods in the order of around ten microseconds. This time resolution is several orders of magnitude higher than the time resolution required for the separation methods used here, and so does not represent a solution to the problem.

Ion storage devices today generally take the form of RF multipole rod systems, in which the two phases of an RF voltage are alternately applied to the pole rods. A pseudopotential is created in the interior that constantly accelerates the ions towards the axis so that they execute oscillations around the potential minimum in the axis. If the rod system is charged with a collision or damping gas at a pressure of around $10^{-2}$ to $10^{+3}$ Pascal, the ion oscillations are quickly damped, depending on the pressure; the ions collect in a thermalized state in the axis of the rod system. The thermalization requires at least a hundred collisions with the molecules of the damping gas. At a pressure of $10^{-2}$ Pascal the damping takes around one millisecond; at a pressure of $10^{+2}$ Pascal the ions are damped in less than one microsecond. The ends of the rod systems are generally closed by diaphragms with DC potentials so that the ions are confined in the interior. It is also possible to close them with pseudopotentials generated by RF voltages across multi-electrode systems, in which case it is possible to store ions of both polarities without switching the voltages.

The term mass here refers to the charge-related mass or mass-to-charge ratio m/z, which is the only one of importance in mass spectrometry, and not simply to the physical mass m. The number z is the number of elementary charges, i.e. the number of excess electrons or protons which the ion possesses and which act externally as the ion charge. All mass spectrometers can measure only the mass-to-charge ratio m/z, not the physical mass m itself. The mass-to-charge ratio is the mass fraction per elementary ion charge. Analogously, the terms light and heavy ions refer to ions with low or high charge-to-mass ratios m/z respectively. The term mass spectrum relates to the mass-to-charge ratios m/z.

There is a need for a storage bank for ions.

SUMMARY OF THE INVENTION

According to an aspect of the present invention, a bank with parallel storage cells, each taking the form of an RF multipole rod system, where neighboring storage cells each share a pair of pole rods so that the contents of the storage cells can be moved into adjacent storage cells by electric voltage pulses at selected pole rod pairs. They are filled with damping gas at a pressure of between about $10^{-2}$ and $10^{+3}$ Pascal. The RF voltages for the pole rods and the DC pulses for the individual pairs of pole rods are supplied by a power supply. The storage cells may be lined up in a single plane or as an open or closed chain of parallel cells on a virtual cylindrical surface. In the storage bank, electrical configurations allow stored ion clouds to be moved into their respective adjacent storage cells at the same time, a fact that is particularly favorable for a closed circular chain of storage cells.

The multipole rod systems of the storage cells are each equipped with terminating electrodes at both ends. The terminating electrodes employ repulsive potentials to keep the ions in the interior of the storage cell; they can form individual electrode systems in front of individual storage cells or extend together over several storage cells. The repulsive potentials may be DC potentials or pseudopotentials generated across multi-electrode systems by RF voltages.

A receiving storage cell is located in front of an ion guide, which guides the ions of an ion current to the bank of ion storage cells. The filling process may be turned on and off by a switchable lens system in front of the receiving storage cell. This receiving storage cell can be filled from the ion guide with ions of an ion current profile. Since the ion guide can be filled with the same collision gas at the same pressure as the storage bank, there are no vacuum problems. The storage bank may include two or more receiving storage cells if ions from different ion currents, for example from different ion sources, are to be stored. The storage bank also includes at least one delivering storage cell, which may be identical to the receiving storage cells but does not have to be. With several delivering storage cells the ions can be fed to different analyzers, for example different mass spectrometers.

If the contents of the storage cells are to be prevented from mixing as they are moved, the storage cells must not all be filled with ion clouds. The stored ion clouds can then be transferred into empty neighboring storage cells. If quadrupole rod systems (i.e., systems with four pole rods) are used as storage cells, then only every third storage cell may be used as an ion storage device. This makes it necessary to have six pole rods per storage device. When using hexapole rod systems, every second rod system can be used as an ion storage device but, in this case, eight pole rods are needed for every ion storage device.

The storage cells are filled with damping gas to thermalize the ions and collect them close to the axis. The speed at which the contents of one storage device can be electrically transferred to the next storage cell depends on the pressure of this damping gas. If the storage bank is operated at a damping gas pressure of one hectopascal, for example, the laws of ion mobility apply to the ion transport. If the storage cells and DC pulses are suitably dimensioned, this pressure is sufficient to move the ion clouds into their respective adjacent storage cells in less than a hundred microseconds, and immediate storage of well-cooled ions in the axis of the multipole rod systems occurs. If the pressure of the damping gas is significantly lower, for example around one Pascal, the time required for the ions to be thermalized becomes a determining time factor. The thermalization time in this case is about 100 microseconds. At a pressure of 0.1 Pascal the thermalization takes around one millisecond.

The storage bank can be used in a variety of ways, for example for the accumulative collection of ions of the same separation fractions from separation runs repeated in rapid succession. It can also be used to divide up ions for transmission to different ion analyzers. The ions can also be subjected to different types of processes at predetermined storage locations, for example different types of fragmentation or reactive modifications of the ions. The storage bank may be used as a mass separator or ion mobility separator.

These and other objects, features and advantages of the present invention will become more apparent in light of the following detailed description of preferred embodiments thereof, as illustrated in the accompanying drawings.

DETAILED DESCRIPTION

Figure 7:
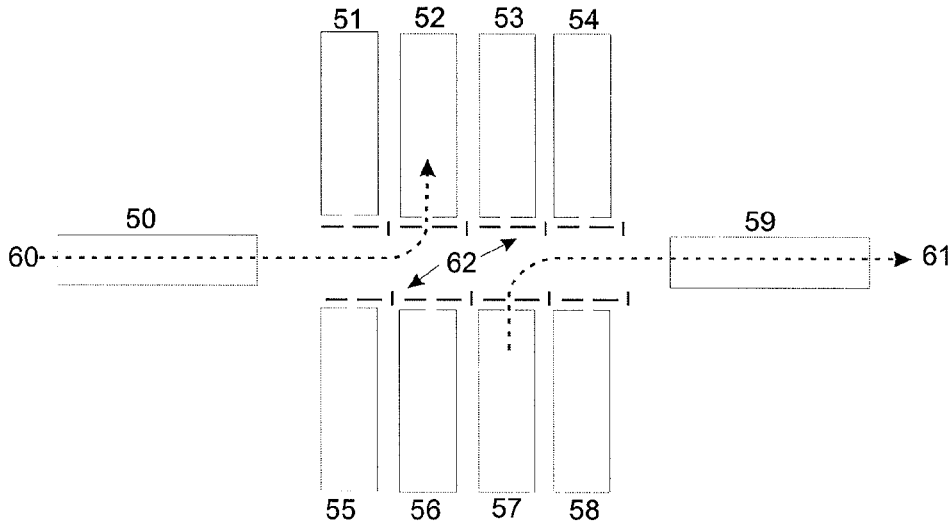
FIG. 7 shows a bank (51 to 58) of ion storage devices arranged in parallel, which can be filled from an ion beam (60) that is fed through an ion guide (50) by switching the guiding electrodes (62) individually to deflect the ion beam (60). This arrangement requires a good vacuum in the ion-optically governed region. They can also be individually emptied in the same way, as is indicated by the ion beam (61). Appropriate voltages across the guiding electrodes (62) are used to switch the ion beam (61), which leaves the ion storage device (57) and is guided to the ion guide (59). The ion storage devices (51 to 58) can lie in a single plane, as shown here, or also be supplemented by additional radially arranged ion storage devices around the axis of the system. In vacuum-technical terms, this arrangement is very difficult to realize.

Ions may be transferred ion-optically from a feed with good focusing properties into ion storage devices with any configuration, as shown schematically in FIG. 7. However, a well-focusing feed in an RF ion guide requires a damping gas inside the ion guide and the ion-optical transfer requires a collision-free region (i.e., a good high vacuum). The ion storage devices, on the other hand, require a damping gas to operate without losses. This type of transfer presents a vacuum problem that can be solved by pumps with extremely high evacuation power. Even then, the transitions between the spaces at different pressure, which require very small apertures, create ion-optical problems. This type of storage bank must therefore be rejected because of the vacuum problems. A solution must be found which transfers the ions from the feeding ion guide into the storage cells without changing the prevailing gas pressures.

It would also be possible, in principle, to arrange parallel storage cells so they can be moved mechanically to achieve an objective of the invention. An arrangement of storage cells in accordance with FIG. 1 accepts the ions from different sections of an ion current profile by rotation, for example. It should be noted that a point in favor of mechanical rotation is that it would allow each storage cell to be used to store ions. But to achieve changeover times in the order of milliseconds, it would be necessary to have very high rotational frequencies with fast start-stop operation for the storage bank, and this is technically very difficult to realize. Movements without lubricants in a vacuum that must be kept analytically clean are always critical, especially when the moved parts must be fed with voltages. For this reason, this solution is likewise discarded here.

According to an aspect of the invention, it is therefore preferable that the contents of the storage device be electrically moved within a stationary storage bank. To achieve this, the storage bank has parallel storage cells, each taking the form of an RF multipole rod system, and with neighboring storage cells each sharing a pair of pole rods so that the contents of the storage cells can be moved into adjacent storage cells by electric voltage pulses across selected pole rod pairs. The storage cells may be arranged in a single plane side-by-side or also be arranged as an open or closed chain of cells in parallel on a virtual cylindrical surface.

Figure 1:
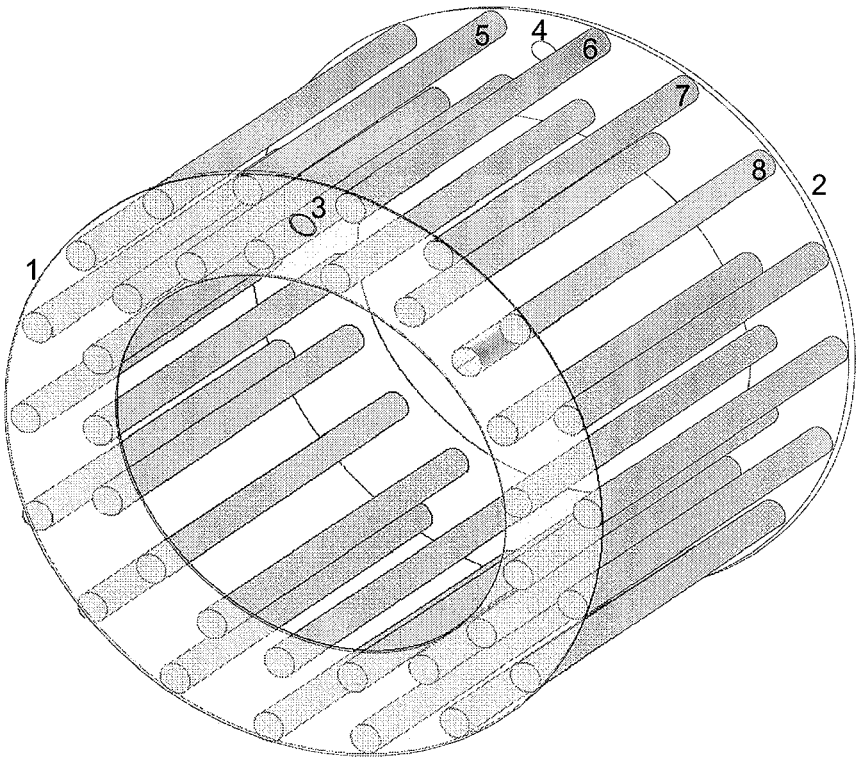
FIG. 1 shows a three-dimensional representation of 18 quadrupole rod systems comprising 18 individual pairs of pole rods (5, 6, 7, 8 etc.) and arranged in a closed circle on a virtual cylindrical surface. DC voltages across two diaphragm rings (1) and (2) keep the ions inside the rod systems; they have apertures (3) and (4) for receiving and delivering ions. With this arrangement, the ions clouds can be cyclically moved round the circle, allowing six ion clouds to be stored.

A simple but very effective embodiment is shown in FIG. 1 for a bank of 18 storage cells which are in the form of a closed chain on a virtual cylindrical surface. The embodiment of FIG. 1 includes 18 rod pairs arranged side-by-side in a circle and creating a total of 18 only slightly distorted RF quadrupole rod systems as storage cells. Six of these can be used to accumulate ions; twelve more storage cells serve to cleanly move the ion clouds. A front terminating diaphragm 1 which is shared by all the storage cells and rear terminating diaphragm 2 which is likewise shared by them all are at electric potentials which keep the ions inside the rod system. In principle, this embodiment is not limited to 18 rod pairs; for example it is thus possible to use 180 rod pairs, which then produce 60 usable storage cells. High numbers of usable storage cells only increase the capacitive and dielectric load on the RF generator; they do not cause any other technical problems apart from a moderate enlargement of the vacuum housing.

Figure 2:
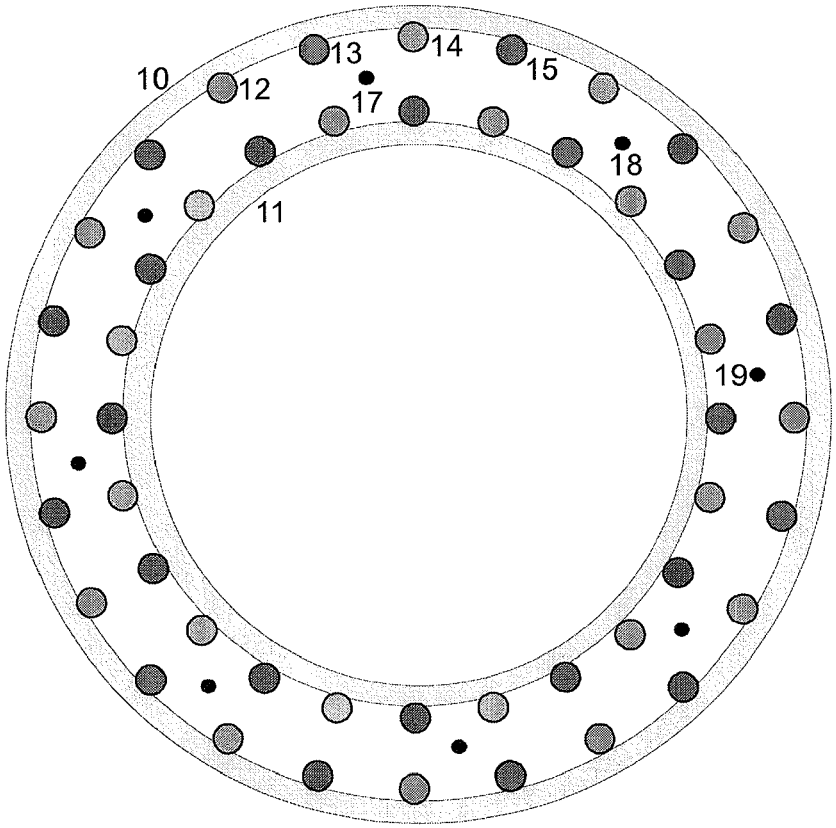
FIG. 2 shows an arrangement of 24 pole rod pairs (12, 13, 14, 15) which form a total of 24 quadrupole rod systems, the outer pole rods being held in position by an outer retaining ring (10) and the inner pole rods by an inner retaining ring (11). The ring can accommodate eight cyclically transposable ions clouds (17, 18, 19).

The retaining devices and the voltage feeders for the pole rods are not shown in FIG. 1; the retaining devices may be made of insulating retaining rings, for example, as shown in FIG. 2. If the retaining rings are made of ceramic, the pole rods may be glued into ground-in grooves, for example. The retaining rings for their part must again be retained. Other embodiments are described below.

Figure 3:
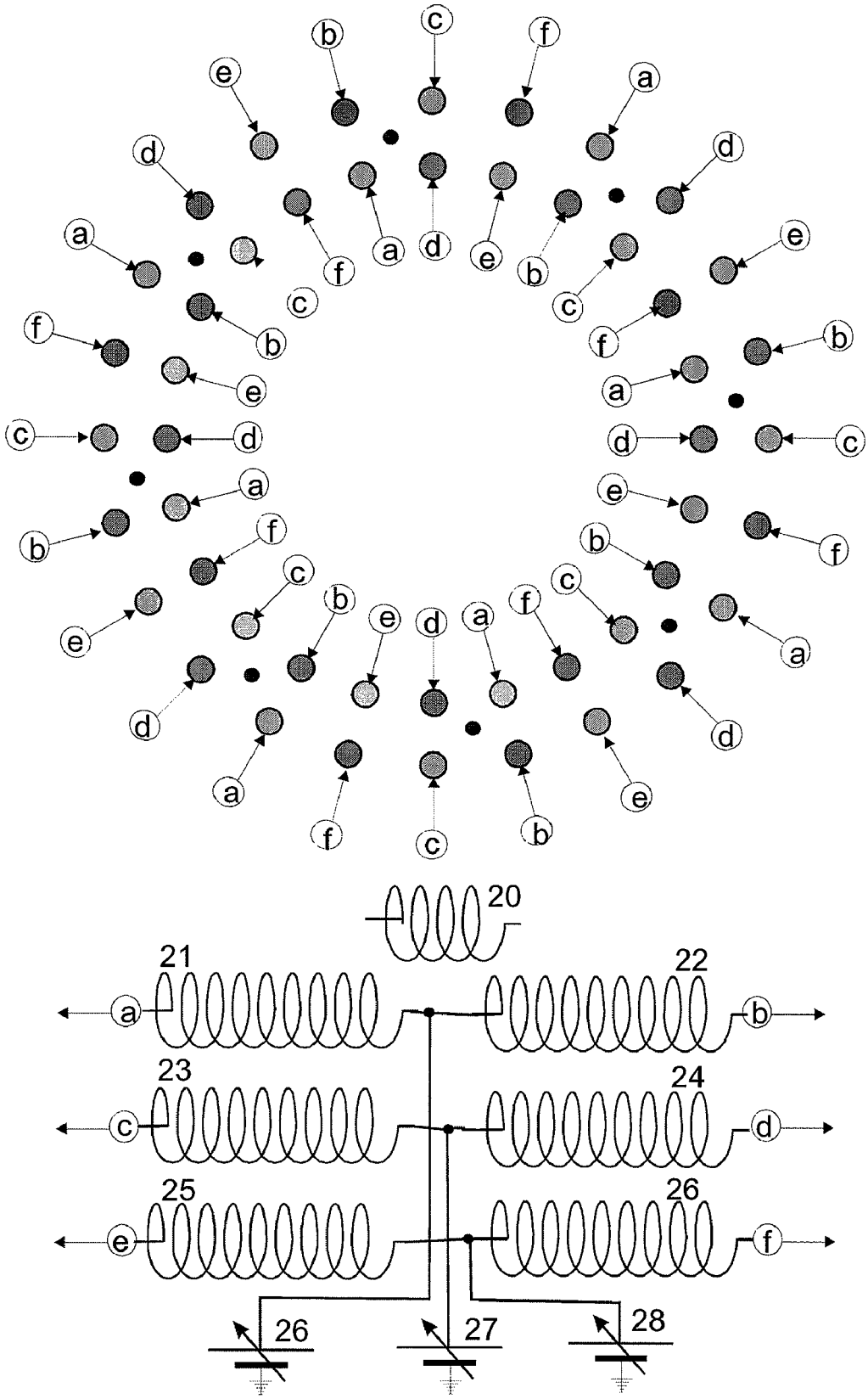
FIG. 3 illustrates the wiring configuration of the 24 pole rod pairs with an RF transformer, which contains three secondary windings (21, 22), (23, 24) and (25, 26). The circuits are identified by letters (a, b, c, d, e, f). The secondary windings each have center taps via which three independent DC voltage pulses (26), (27) and (28) can be introduced and superimposed on the RF voltages. Each DC voltage acts on a pair of rods comprising an inner and an outer pole rod. The ions clouds can be transferred into their respective adjacent quadrupole rod systems by short DC pulses.

In order that the contents of the storage devices are transported quickly from one ion storage device to the next, all the contents of the storage devices are moved into the adjacent storage cells at the same time. FIG. 3 illustrates the wiring of the pole rods from an RF transformer with three secondary windings with center taps, which makes it possible to have such a circular transport of the stored ion clouds.

Figure 4:
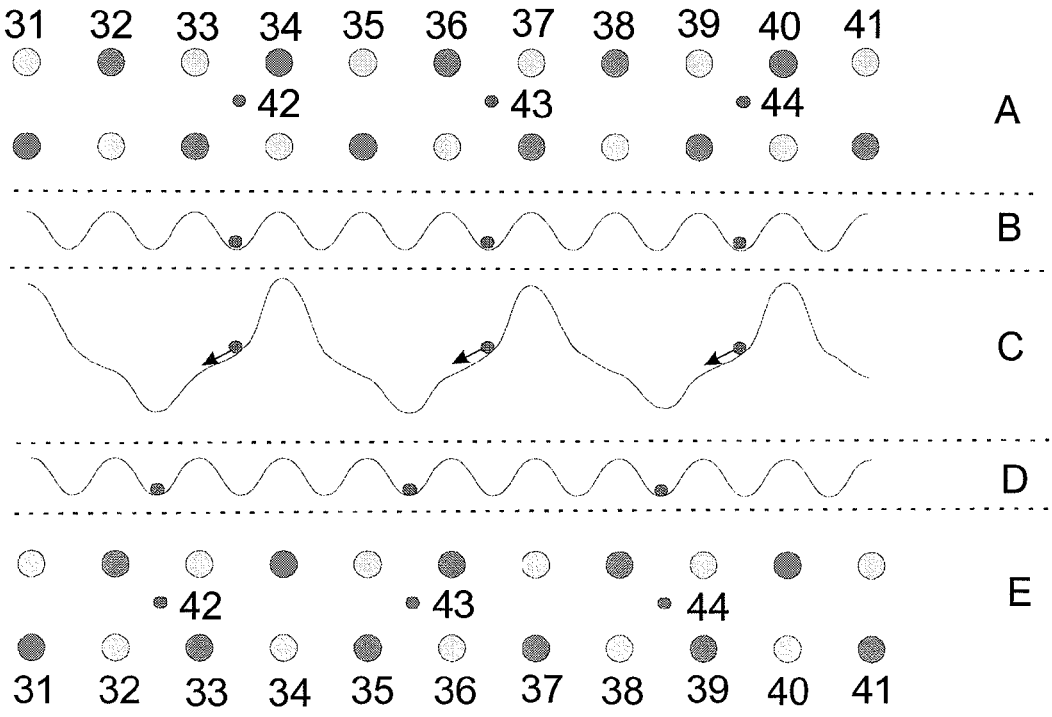
FIG. 4 schematically illustrates the transfer process. The top strip A shows a series of rod pairs (31 to 41) in a single plane, which each form a quadrupole storage cell. These cells are filled with three ion clouds (42), (43) and (44). The pseudopotentials are distributed across the middle of these storage cells, as can be seen in strip B: in the middle of each of these storage cells the pseudopotential is at a minimum; towards the adjacent storage cell there is a barrier. If, at every filled storage cell, the pair of pole rods adjacent to the ion cloud is charged with a DC pulse, the ion clouds are driven into the adjacent storage cell by superimposing the DC voltages onto the pseudopotentials, as can be seen in strip C. When the DC pulse ends, the ion clouds are in the adjacent storage cells, as shown in the two strips D (for the pseudopotential) and E (for the storage cells). The ion clouds can be cyclically moved onward by repeatedly applying DC pulses across different pairs of rods.

The mechanism whereby the ion clouds are simultaneously transported into their adjacent storage cells is shown schematically in FIG. 4. FIG. 4 illustrates several storage cells in a single plane but they can also be understood as storage cells of a very large, closed circular chain. The top strip A shows a series of storage cells with pole rod pairs 31-41 and ion clouds 42, 43 and 44. Two adjacent pole rod pairs form a storage cell in each case. Strip B shows the pseudopotential passing through the middle of the pole rod pairs, each having a minimum between the pairs of pole rods and a transfer barrier between the two pole rods of a pole rod pair. If an ion-repelling DC potential is now superimposed on the RF voltage across each of the pole rod pairs 34, 37 and 40 next to the ion clouds, the potential superimposed (shown in strip C) presses the ion clouds through the adjacent pole rod pairs 33, 36 and 39 into the adjacent storage cells. After the procedure has been repeated twice, the ion clouds have moved along three rod pairs, and the receiving storage cell (not shown in FIG. 4) is again available for filling from the ion stream.

Instead of DC pulses, RF pulses can also be imposed on the pole rod pairs to drive the ions into the adjacent storage cell. The RF pulses generate an ion-repelling pseudopotential. The RF pulses have to be just high enough to eliminate the minimum of the pseudopotential in the storage cell. The advantage of the RF pulses lies in the fact that the potential minimum for ions of all masses disappears at the same time (i.e., there is no mass discrimination). The disadvantage is that the RF pulses must have a high voltage.

At a pressure of around one hectopascal, heavy ions with m/z equal to 5,000 daltons drift in an electric field of around one volt per millimeter at a speed of around 30 millimeters per millisecond. In an annular storage bank where the pole rods are each around two millimeters in diameter and the axes of the storage cells are around five millimeters apart, the ions are driven into the adjacent cell by DC pulses in the order of about 50 volts in less than a hundred microseconds. Lighter ions migrate faster but must overcome a higher barrier of the pseudopotential so that the potential gradient to drive the mobility is lower overall. A few microseconds are sufficient to restore a thermally stabilized ion cloud by collision cooling. It is thus possible for three such transport processes to occur in an overall time of much less than one millisecond. This storage bank for ions thus meets the requirements concerning the speed of switchability. If the rod systems are around 50 millimeters long, each storage cell can accommodate between about $10^6$ and $10^7$ ions.

At much lower damping gas pressures, for example in the pressure range between 0.1 and 1 Pascal, the motion of the ions is no longer determined by their mobility in the damping gas; they can move much faster. But their thermalization then takes longer and becomes the determining time factor. At a pressure of around one Pascal the thermalization occurs in around 100 microseconds; the transfer of the ions into the adjacent storage cell also needs around this same time. This means that, at this pressure as well, the contents of the storage devices can also be moved three storage cells further on in less than one millisecond.

Figure 9:
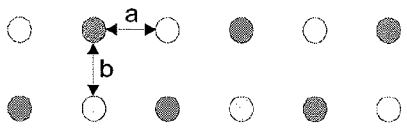
FIG. 9 shows several storage cells in a single plane where, for protection against ion losses, the separations (a) between the outer pole rods are smaller than the separation (b) between the two rows of outer pole rods in order to make the barrier of the pseudopotential in the separations (a) higher than in the separations (b).
Figure 10:
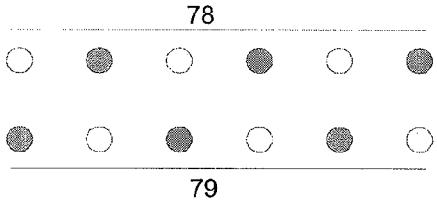
FIG. 10 shows two auxiliary electrodes (78) and (79) outside several storage cells in a single plane. A DC potential across the auxiliary electrodes reduces the ion losses when the contents of the storage device are moved.

The situation is different at a pressure of around 0.1 Pascal. In this case, the thermalization takes around a millisecond so that three moves will take at least three milliseconds. In the potential well of the new storage cell, the ions only experience a damping collision in approximately every third oscillation cycle. This can also lead to ion losses if the lateral potential barriers at right angles to the row of storage cells are surmounted as a result of collision cascades. It is therefore favorable to increase these barriers by distorting the arrangement of the pole rods of the multipole rod systems or by employing externally mounted auxiliary electrodes with repelling DC voltages, as shown in FIGS. 9 and 10.

To transport several ion clouds at the same time through the quadrupole storage cells it must also be possible to apply DC pulses independently of each other across three adjacent rod pairs in addition to the RF voltage. An electric configuration for this is shown in detail in FIG. 3. This requires three secondary windings 21, 22; 23, 24 and 25, 26 of an RF transformer with center taps. The DC pulses generated in the generators 26, 27 and 28 are fed via the center taps. This configuration with three secondary windings can be used for storage banks with any number of rod pairs (i.e., any number of storage cells). The number of rod pairs must be divisible by six since only every sixth rod pair again exhibits the same potential supply, including a phase of the RF voltage with the same polarity.

The height of the barrier of the pseudopotential between two pole rods is a function of the amplitude of the RF voltage and the diameter of the pole rods with respect to the distance between two diagonal pole rods, and can largely be selected as desired. In particular, the height of the barrier is also inversely proportional to the mass of the ions; ions of high mass are thus easier to move than lighter ions because of the lower pseudopotential barrier, but their mobility, and hence the speed of their transfer into the neighboring cell, is lower. Using RF pulses creates other conditions, which have already been explained above.

If the damping gas in the storage bank has a high pressure of around one hectopascal, the DC pulse can have a temporally constant height without any disadvantages. The ions of different masses then migrate under the influence of the electric field, but decelerated by the damping gas, at their mass-dependent migration rate into the neighboring cell and remain thermalized practically throughout. At low damping gas pressures, this type of DC pulse with constant height is unfavorable since the ions receive enough kinetic energy to fragment in collisions. The DC pulse must be relatively high, for example 50 to 100 volts, in order to also lift light ions over the barrier of the pseudopotential, which is high for them. At low pressure it is therefore better to form the DC pulse as an increasing voltage ramp. Heavy ions then flow into the neighboring cell early when the voltage of the DC pulse is still low because they have only a low barrier of the pseudopotential in front of them. They therefore absorb a little kinetic energy and cannot fragment.

Figure 6:
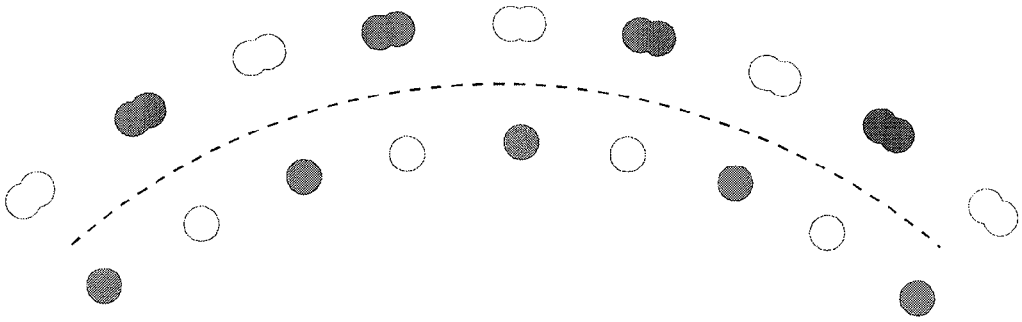
FIG. 6 illustrates that in cylindrically arranged quadrupole rod systems, too, it is possible to reduce the distortion of the quadrupole fields in the interior of the quadrupole rod systems by broadening the outer pole rods of each pair of rods.

The slight distortion of the RF quadrupole fields in the circular quadrupole rod systems can be reduced by shaping the cross-section of the pole rods. As shown in FIG. 6, it is sufficient to broaden the outer pole rods of each pole rod pair. This shape also increases the pseudopotential barrier between the outer pole rods so that fewer ions are lost.

A high damping gas pressure hinders fast filling, and particularly fast emptying, of the receiving and delivering storage cells. The storage cells should therefore not be very elongated so that potentials of the terminating electrodes or potential penetrations of lens voltages can reach the ions in the interior through the apertures of the terminating electrodes. It is favorable if the storage cells are not longer than around ten times the rod distance measured diagonally between opposite pole rods. The ion guides, which are likewise at a high damping gas pressure and which guide the ions to the storage bank, should be equipped with an active forward drive of the ions in the interior by axial potential gradients. A person of ordinary skill in the art will recognize that there are several methods of achieving this.

The rod pairs do not have to be individually held by insulating retaining rings. The interior pole rods, which are all connected to the same supply voltage (i.e., either to a, b, c, d, e, or f in FIG. 3), may be retained by a metallic connecting ring, as analogously presented in U.S. Patent Application US-2006-0027745-A1 for multipole rod systems. The connecting rings with one sixth of the inner pole rods can be manufactured by wire erosion simply from a lathed part, for example. Six such connecting rings for inner pole rods can be interconnected via insulating discs. If the connecting rings are selected so as to be symmetric to a middle insulating disc, only three shapes have to be manufactured for the interior pole rod arrangements. The same applies for the outer pole rods. This method of manufacture is worthwhile if storage banks with large numbers of storage cells are to be manufactured.

Figure 5:
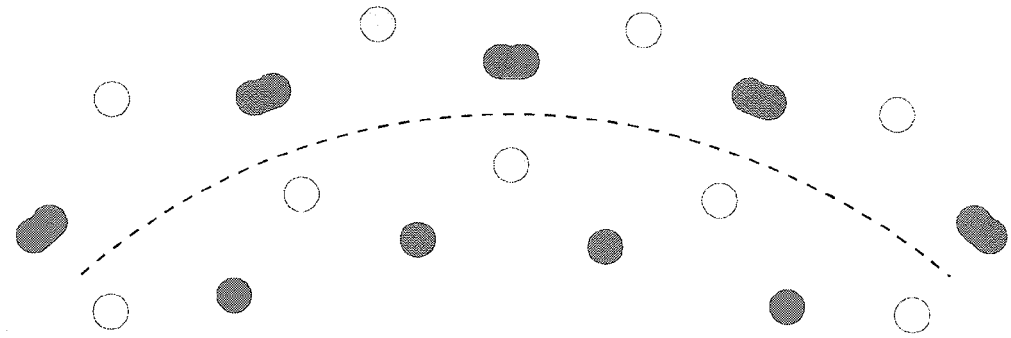
FIG. 5 shows a section of a cylindrical arrangement of storage cells in the form of hexapole rod systems. The outer pole rod of the respective shared pair of rods is wider in order to reduce the distortion of the hexapole field.

It is also possible to use hexapole rod systems for the storage cells, as is schematically shown in FIG. 5. Here, as well, it is possible to reduce distortion of the hexapole fields by broadening the outer pole rods of each shared pair of pole rods. With a chain of hexapole rod systems it is possible to fill every second storage cell with ions if the ion clouds are to be switched onward into the adjacent storage cells by DC pulses. This requires that several DC potentials of different heights be applied simultaneously across several rod pairs. RF transformers with four secondary windings may be used to electrically configure the pole rods. Furthermore, since four pole rod pairs are required for each effectively usable ion storage device, the use of hexapole storage cells seems to be somewhat less favorable than the use of quadrupole storage cells, for which only three pole rod pairs per ion storage device are required. The barriers of the pseudopotentials are also higher with hexapole storage cells than with quadrupole storage cells.

The hexapole systems may also be manufactured by wire erosion from turned parts. In this case, only four different shapes are required in total, two for the outer and two for the inner pole rods.

The storage bank may be used for all types of accumulative storage of ions. This is the case with all fast separation techniques where only relatively few analyte molecules are separated each time. For such accumulative storage of individual ion fractions, the storage bank with a closed circular chain of storage cells is particularly favorable because it can be filled cyclically round the circle.

This storage bank may be used in mass spectrometers equipped with a drift region to separate the ions based on their mobility. These drift regions operate at collision gas pressures of between one and roughly twenty hectopascal; complete separation is completed after between 30 and a maximum of around 100 milliseconds. A storage bank of this type can be used to accumulatively store the ions from 30 separation runs, each of about 30 milliseconds duration in about one second. If it is possible to move each of the ion clouds three storage cells further on in only half a millisecond, and if it is also possible to fill the storage cell in about half a millisecond, then a storage bank with some thirty fillable storage cells (i.e., with a total of 90 storage cells, can be used). Such fraction accumulation is favorable for ion mobility spectrometers. Ion mobility spectrometers generally do not have a very high resolution since the diffusion processes unavoidably lead to broadenings of the migrating ion clouds in the direction of migration. The broadening of the migrating ion clouds in the transverse direction may be limited by confining the drift region in RF multipole fields.

For other purposes, however, a storage bank with storage cells in a single plane may be more favorable. This may be the case when ions are taken from the ion current profile for a reactive process to be then fed to the same or, in particular, a second ion analyzer as well.

The main reactive process is the fragmentation of the ions. Two types of fragmentation have proved important and complementary, especially for the fragmentation of peptide and protein ions: the collisionally induced dissociation type (CID) and the electron capture dissociation (ECD) type. CID-type fragmentations may also be brought about by the absorption of large numbers of light quanta (IRMPD=infrared multiphoton dissociation). Alternatively, ECD-type fragmentations can also be achieved by electron transfer by negative ions (ETD=electron transfer dissociation) or highly excited neutral particles (MAID=metastable atom induced dissociation). A comparison of the fragment ions from both types of fragmentation provides extraordinarily good information about the structure of the ions. In a storage bank it is thus possible to sample the same type of ion from the ion stream twice, to feed them to two special storage cells and subject them to two different types of fragmentation. They can subsequently be fed to a mass spectrometer to acquire the fragment mass spectra. This can be done by feeding the ions back to the receiving storage cell, if it also acts as the delivering cell, or by transporting them onward to a special delivering storage cell.

Figure 11:
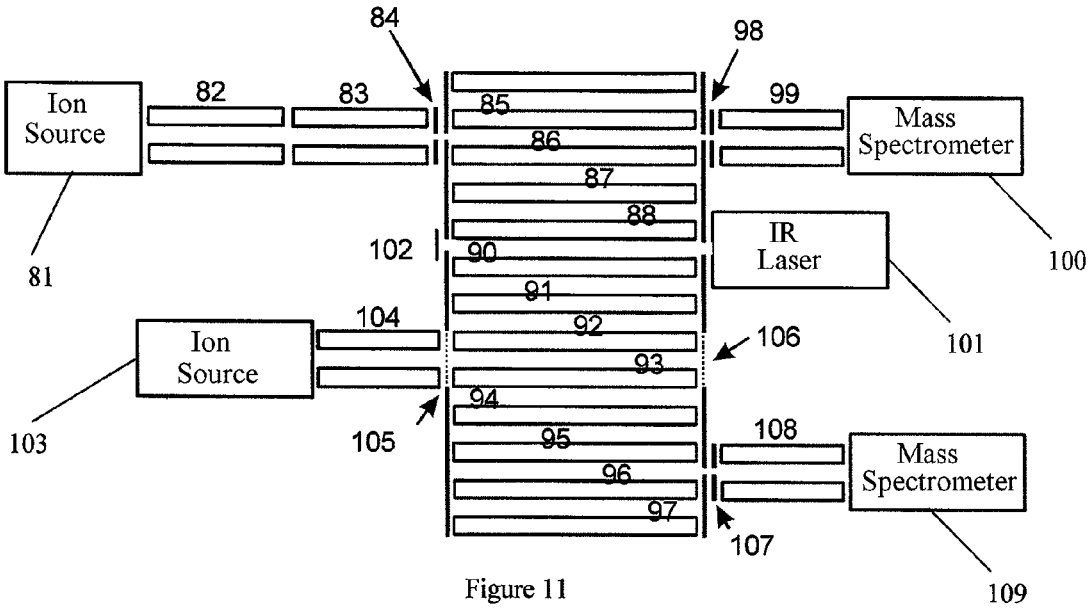
FIG. 11 is a schematic representation of a plane storage bank with 12 storage cells (85 to 97) where an infrared laser (101) can fragment analyte ions selected according to their mass by infrared multiphoton dissociation (IRMPD) in storage cell (90), and fragmentation by electron transfer dissociation (ETD) can be undertaken in storage cell (93) by feeding in negative ions from the ion source (103). The analyte ions are generated in the ion source (81) and fed via a quadrupole filter (82) and a pre-storage cell (83), through the storage cell (86), then via an ion guide (99) to a mass spectrometer (100) for analysis. Analyte ions of interest can be selected and moved into the storage cells (90) and (93). The fragment ions can either be moved back into the storage cell (86) and analyzed in the mass spectrometer (100) or moved onward and analyzed in a specially adapted mass-spectrometer (109).

FIG. 11 is a schematic representation of such a mass spectrometer configuration with a storage cell 90 for IRMPD, fed by an infrared laser 101, and a storage cell 93 for ETD, fed from an ion source 103, to generate suitable negative ions. In order for the negative ions to be added to the positive ions in the storage cell 93, this storage cell 93 is sealed with pseudopotentials which are generated across grid-like electrode structures 105 and 106 by applying an RF voltage.

The mass spectrometer configuration shown in FIG. 11 can be operated as follows: Analyte ions are generated in the ion source 81 and fed via a quadrupole filter 82 which is initially not in mass-selective mode, a pre-storage cell 83, the receiving and delivering storage cell 86 of the storage bank and an ion guide 99 to a mass spectrometer 100 for analysis. The mass spectra are analyzed in real time. Unknown analyte ions whose identity or structure is to be determined by scanning a fragment spectrum can then be selected according to their mass in the quadrupole filter 82 when it is in mass-selective mode; generally it is the doubly or triply charged analyte ions that are selected. These selected analyte ions are collected in the receiving storage cell 86 and then initially moved into the storage cell 90. During the brief transfer process, the stream of ions into the storage cell 86 is interrupted by the switchable lens 84; the ions of the ion current profile then collect in the pre-storage cell 83. After the selected analyte ions have been collected again in storage cell 86, they are moved into storage cell 90, with the result that the analyte ions are automatically moved onward from storage cell 90 into the storage cell 93.

While the normal analytical operation from the ion source 81 to the mass analyzer 100 can continue by opening the switchable lenses 83 and 98, the fragmentation processes can proceed in the storage cells 90 and 93. The fragmentations take between 20 and 400 milliseconds but they do not hold up the tracing of the changes in the ion stream. In the storage cell 90 the analyte ions selected according to their mass are fragmented by an infrared laser 101 using infrared multiphoton dissociation (IRMPD); in the storage cell 93 the ions are fragmented by electron transfer dissociation (ETD) by feeding in suitable negative ions from the ion source 103. The fragment ions can then (with a brief interruption of the analytical method) be either moved back into the storage cell 86 and analyzed in the mass spectrometer 100, or they can be moved onward into the storage cell 97 and then analyzed by acquiring the fragment ion spectra in a mass spectrometer 109 specially designed for measuring fragment ion spectra.

Other methods of processing ions are also possible in such storage cells, for example "charge stripping" of multiply charged ions or complexing of ions with complex-forming neutral molecules which are fed to the storage cell.

A storage bank may itself also be used as a mass separator. If the first storage cell is filled with a mixture of ionic species with different masses, then mass separation can be achieved as the ions are jointly moved into neighboring cells. This requires that the transport begins with very high DC pulses, so that almost all ionic species are transported onward. Only the lightest ions, for which the pseudopotential barrier is very high, cannot surmount this barrier and remain in the original storage cell. If the voltage of the DC pulses is reduced further and further in subsequent transport cycles, increasingly heavy ions remain behind: mass separation of the ions occurs. The ions are sorted according to their mass and thus distributed over the storage cells.

Under certain conditions the storage bank may also be used as an ion mobility spectrometer. This requires that the first storage cell be filled with ions whose masses are as near identical as possible. If, during the joint transport, these ions are moved onward with very brief DC pulses, initially with small and then larger and larger voltages, the ions are separated according to their mobility. The brevity of the DC pulses means only the very mobile ions reach the next storage cell at low voltage; at higher voltages also increasing numbers of less mobile ions. The ions are distributed over the storage cells according to their mobility. However, this method depends on there being a prior separation according to mass, either by a conventional mass filter, or by a mass separation using the above method.

The size of these storage banks is not a hindrance to using a large number of storage cells. A chain-shaped storage bank with 90 storage cells, which can store 30 ion clouds accumulatively, has a diameter of only about 160 millimeters if the above-mentioned dimensions of 2 millimeter pole rod diameter and 5 millimeter separation are chosen. This bank can be constructed as a dipping system on a flange, for example, where the ion guide for filling can be contained in a welded-in tube, and the flange also carries all voltage input glands.

Figure 8:
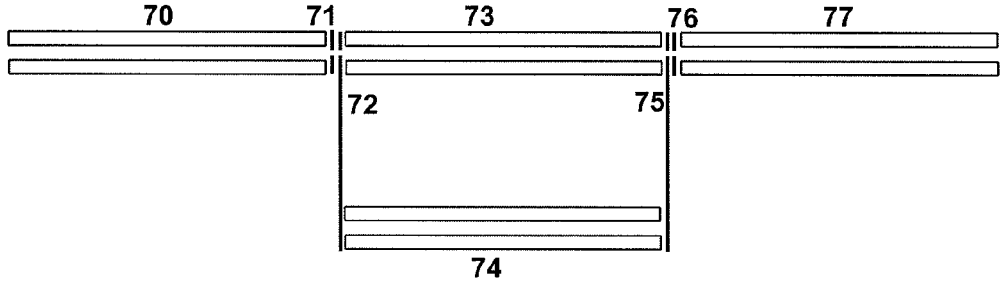
FIG. 8 shows a storage bank with a feeding ion guide (70), a transfer lens (71), a front terminating diaphragm (72), cylindrically arranged storage cells (73, 74), rear terminating diaphragm (75), transfer lens (76) and lead-off ion guide (77). The cylindrically arranged storage cells (73, 74), which form the storage bank in the narrow sense, can be rotated step-by-step to fill the individual storage cells; alternatively, the accumulated ion clouds can also be transported onward round the circle in a stationary storage bank.

The ions stored in the storage cells of the ion storage bank can be transported out by electrically configuring the terminating electrodes, especially by penetrations of lens voltages through apertures in the terminating electrodes, and thus fed to various types of analytical process. FIG. 8 shows lens diaphragms 71 and 76 whose potentials penetrate through apertures in the terminating diaphragms 72 and 75.

The analytical processes to which the ions are fed include mass spectrometric analytical methods or ion mobility spectrometric methods.

The terminating electrodes shown in FIG. 1 as rings with only two apertures may also have a more complex construction. In particular, the terminating electrodes for receiving or delivering may be constructed as lens systems that are kept separate from the terminating electrode ring. Furthermore, the receiving and delivering of ions do not have to be performed by the same storage cell.

The delivering storage cell can also be designed so that it has a switchable axial potential gradient, for example by the penetration of two outer electrodes along the storage cell, or by voltage drops across the pole rods of this storage cell itself. Such potential gradients can be used to quickly empty the cell.

With knowledge of this invention those skilled in the art will also be able to develop further embodiments and further applications.

Although the present invention has been illustrated and described with respect to several preferred embodiments thereof, various changes, omissions and additions to the form and detail thereof, may be made therein, without departing from the spirit and scope of the invention.

What is claimed is:

1. An ion storage bank, comprising: storage cells, wherein the storage cells take the form of RF multipole rod systems and are arranged in parallel, adjacent storage cells each sharing one pair of pole rods, and a voltage generator can supply a common DC or AC pulse to the two pole rods of a shared pole rod pair to drive stored ions into an adjacent storage cell.

2. The ion storage bank of claim 1, wherein the storage cells are arranged in parallel in a single plane.

3. The ion storage bank of claim 1, wherein the storage cells are arranged in parallel in an open or closed circular chain of cells.

4. The ion storage bank of claim 1, wherein the pole rods of the storage cells each form a quadrupole rod system.

5. The ion storage bank of claim 4, wherein an electric voltage supply is available which supplies every third pair of pole rods with the same DC and RF voltages.

6. The ion storage bank of claim 5, wherein an RF transformer with three secondary windings, each with center taps, is used to connect the pole rods, and DC or RF voltage pulses can be superimposed on each of the three RE voltages via the center taps.

7. The ion storage bank of claim 1, wherein the pole rods of the storage cells each form a hexapole rod system.

8. The ion storage bank of claim 1, wherein the storage cells are filled with a damping gas at a pressure of between $10^{-3}$ and $10^{+2}$ Pascal.

9. The ion storage bank of claim 1, wherein it contains a receiving storage cell and a delivering storage cell.

10. The ion storage bank of claim 1, wherein at least one of the storage cells is equipped with devices to fragment the stored ions.

11. The ion storage bank of claim 1, wherein at least one of the storage cells is equipped with devices to reactively modify the stored ions.

12. The use of an ion storage bank of claim 1 for accumulative storage of ions of the same separation fraction which originate from a separation process carried out repeatedly.

13. The use of an ion storage bank of claim 1 for the separation of the ions according to masses by decreasing the voltages of the DC pulses during repeated transport into neighboring cells.

14. The use of an ion storage bank of claim 1 for the separation of ions of approximately the same mass according to their mobility by increasing the voltages of the DC pulses during repeated transport into neighboring cells.

15. An ion storage bank, comprising:

a plurality of parallel storage cells each containing damping gas, where each of the plurality of parallel storage cells includes an RF multipole rod system and immediately adjacent storage cells share a pair of pole rods; and a voltage generator that supplies an electric pulse to the pair of pole rods of the shared pole rod pair to drive stored ions into an immediately adjacent storage cell.

16. An ion storage and analysis system that receives ions from an ion source, comprising:

an ion storage bank that receives and stores the ions, where the storage bank comprises a plurality of parallel storage cells each containing damping gas, where each of the plurality of parallel storage cells includes an RF multipole rod system and immediately adjacent storage cells share a pair of pole rods;

a controller that supplies an electric pulse to the pair of pole rods of the shared pole rod pair to drive stored ions into an immediately adjacent storage cell; and a mass spectrometer that receives stored ions from the ion storage bank.

* * * * *

UNITED STATES PATENT AND TRADEMARK OFFICE

CERTIFICATE OF CORRECTION

PATENT NO. : 7,718,959 B2
APPLICATION NO. : 11/843753
DATED : May 18, 2010
INVENTOR(S) : Franzen et al.

It is certified that error appears in the above-identified patent and that said Letters Patent is hereby corrected as shown below:

Column 6
Line 41, delete "RE" and insert --RF--

Signed and Sealed this

Twenty-second Day of June, 2010

David J. Kappos

David J. Kappos
*Director of the United States Patent and Trademark Office*